US007726950B2

(12) United States Patent
Hansen et al.

(10) Patent No.: US 7,726,950 B2
(45) Date of Patent: Jun. 1, 2010

(54) FLUID SUPPLY UNIT HAVING AN INTEGRAL PRESSURE GENERATOR AND PRESSURE BOOSTER

(75) Inventors: Leif Hansen, Soenderborg (DK); Peter J. M. Clausen, Nordborg (DK); Christen Espersen, Augustenborg (DK)

(73) Assignee: miniBooster Hydraulics A/S, Soenderborg (DK)

( * ) Notice: Subject to any disclaimer, the term of this patent is extended or adjusted under 35 U.S.C. 154(b) by 407 days.

(21) Appl. No.: 10/532,419

(22) PCT Filed: Oct. 9, 2003

(86) PCT No.: PCT/EP03/11150

§ 371 (c)(1),
(2), (4) Date: Apr. 22, 2005

(87) PCT Pub. No.: WO2004/038220

PCT Pub. Date: May 6, 2004

(65) Prior Publication Data

US 2005/0265859 A1 Dec. 1, 2005

(30) Foreign Application Priority Data

Oct. 23, 2002 (DE) ..... 102 49 524

(51) Int. Cl.
*F04B 17/00* (2006.01)
*F04B 9/08* (2006.01)

(52) U.S. Cl. ..... 417/225; 417/390

(58) Field of Classification Search ..... 417/60, 417/360, 369, 225, 390; 60/485, 486, 477, 60/458, 456, 452; 30/180, 228; 37/331; 73/152.26; 91/300
See application file for complete search history.

(56) References Cited

U.S. PATENT DOCUMENTS 1,114,659 A * 10/1914 Weld ..... 417/225

(Continued)

FOREIGN PATENT DOCUMENTS

DE 38 31 965 3/1990

(Continued)

OTHER PUBLICATIONS

Catalog of "Sachsenhydraulik GMBH Chemnitz", 1994, p. 22.

(Continued)

*Primary Examiner*—Charles G Freay
(74) *Attorney, Agent, or Firm*—Friedrich Kueffner

(57) ABSTRACT

A fluid supply unit includes a hydraulic supply unit and a pressure generator for the fluid and a pressure outlet. A pressure booster is installed between the pressure generator and the pressure outlet and is rigidly mechanically connected with the pressure generator, wherein the pressure booster (6) is driven by a portion of the fluid generated by the pump.

10 Claims, 1 Drawing Sheet

U.S. PATENT DOCUMENTS

| | | | | | |
|---|---|---|---|---|---|
| 2,733,571 | A | | 2/1956 | Gardiner | |
| 3,016,835 | A | * | 1/1962 | Bessiere | 417/225 |
| 3,837,076 | A | * | 9/1974 | Good, Jr. | 30/180 |
| 4,086,034 | A | * | 4/1978 | Hokky | 417/369 |
| 4,393,749 | A | * | 7/1983 | Miyazaki | 91/376 R |
| 4,659,292 | A | | 4/1987 | Wells et al. | |
| 4,671,063 | A | * | 6/1987 | Anaker | 60/458 |
| 4,680,879 | A | * | 7/1987 | Hill et al. | 37/331 |
| 4,845,982 | A | * | 7/1989 | Gilbert | 73/152.26 |
| 5,243,761 | A | | 9/1993 | Sullivan et al. | |
| 5,394,693 | A | | 3/1995 | Plyter | |
| 5,477,680 | A | | 12/1995 | Heskey et al. | |
| 5,868,122 | A | * | 2/1999 | Gram et al. | 123/527 |
| 6,092,290 | A | * | 7/2000 | Vogelsanger | 30/228 |
| 6,295,914 | B1 | * | 10/2001 | Iversen | 91/300 |

FOREIGN PATENT DOCUMENTS

| | | |
|---|---|---|
| DE | 197 17 295 | 10/1998 |
| DE | 697 03 069 | 5/2001 |

OTHER PUBLICATIONS

Brochure of "Hochdruck- Und Sonderhydraulik GMBH".
Description Concerning "Hochdruck—Kleinaggregate 2000 Bar".

* cited by examiner

FLUID SUPPLY UNIT HAVING AN INTEGRAL PRESSURE GENERATOR AND PRESSURE BOOSTER

The invention concerns a fluid supply unit, especially a hydraulic supply unit, with a pressure generator for the fluid, especially a pump for hydraulic fluid, and a pressure outlet.

A supply unit of this type is described, for example, in DE 197 17 295 A1. The unit described there is used as a pump for heating oil in an oil burner. However, it can also be used to bring hydraulic fluid to a higher pressure, so that the hydraulic fluid can be used to drive tools, machines, or the like.

U.S. Pat. No. 5,477,680 describes a motor-driven hydraulic tool, in which a motor drives a pump, which is mounted directly on the tool. When the motor is started, it drives the pump, which in turn makes available hydraulic fluid under a pressure that is capable of driving the tool. U.S. Pat. No. 5,243,761 describes a similar design for a portable tool.

The use of a combination of a pump with a motor and a tool has the advantage that the tool can be hydraulically operated even if otherwise no general hydraulic fluid supply is available. Especially in the case of manual tools, the pump, which, of course, must be portable in this case, makes it possible to open up new applications. In the case of stationary applications as well, the hydraulic pump makes it possible to develop new possibilities on site. For example, hydraulic tools can be used in machine tools, which in and of themselves are not equipped with hydraulics.

The goal of the invention is to broaden the range of potential applications.

This goal is achieved with a fluid supply unit of the aforementioned type by installing a pressure booster between the pressure generator and the pressure outlet, which pressure booster is rigidly mechanically connected with the pressure generator.

The pressure generator, which is designed as a pump when hydraulic fluid is used as the fluid, and the pressure booster thus constitute a unit. The invention is described below on the basis of the example of a hydraulic supply device that delivers a hydraulic fluid. However, it can also be used with gases. Accordingly, in this case it represents a pneumatic supply device. In the case of a pneumatic device, one would use a compressor, i.e., a "gas pump", as the pressure generator. The terms "pressure generator" and "pump" are used synonymously in the discussion which follows. However, in contrast to the pump alone, the unit is able to make hydraulic fluid or gas available under an increased pressure. This expands the range of potential applications, because it then also becomes possible to operate equipment that requires a higher pressure. A higher pressure could otherwise be achieved only with pumps that are designed for generating higher pressures. However, these high-pressure pumps are generally very expensive. They also consume more energy than a combination of a pump and a hydraulic or pneumatic pressure booster. In addition, a high-pressure pump usually weighs more than a unit that consists of a pump and a pressure booster. The motor used to drive the pump can also be kept smaller. The motor output can also be increased by a higher speed, so that the pump can make available a larger amount of hydraulic fluid or gas. Although this larger amount is not completely brought to the increased pressure in the pressure booster, because a portion of the volume of fluid is used to "drive" the pressure booster, it is possible to produce a sufficient amount of hydraulic fluid or gas under an increased pressure. It is not absolutely possible for the user to recognize from the outside whether he is operating a pump alone or a pump with a pressure booster, because the pump and the pressure booster constitute a unit that can be operated as an integrated unit. However, this unit delivers hydraulic fluid or gas under an increased pressure, so that applications become possible which were previously impossible due to a lack of adequate pressure.

The pressure generator and the pressure booster are preferably installed in a common housing, in which connections run between the pressure generator and the pressure booster. Thus, external connections between the pressure generator and the pressure booster are no longer needed. This has several advantages. For one thing, the risk of damaging such lines is small. For another, the connection distances between the pressure generator and the pressure booster can be kept short, so that flow losses remain small. Finally, the lines or connections can be constructed relatively stably, so that even an increased pressure load does not result in an overload.

In this regard, it is preferred for the housing to be constructed of more than one part. Each part of the housing can then be specifically adapted to the given purpose, for example, one part can be constructed to hold the pump and the other part to hold the pressure booster. This makes manufacturing easier.

Two housing parts preferably have a joining surface, which together form an interface between the pressure generator and the pressure booster. The two parts of the housing, which hold the pressure generator, on the one hand, and the pressure booster, on the other hand, can be joined by a flange and in this way ensure the transfer of the hydraulic fluid from the pump to the pressure booster and possibly in the opposite direction. In this way, the unit has a modular construction, which has the advantage that individual modules can be replaced by another. For example, a pressure booster can be operated with different pumps, or a pump can be operated with different pressure boosters.

A tank is preferably rigidly connected with the combination of pressure generator and pressure booster. The tank holds hydraulic fluid that is circulated by the pump. It does not have to be too large if it is ensured that the hydraulic fluid "consumed" by the application is immediately recirculated to the unit. The whole unit with the connected application is then self-supplying, so to speak.

In this regard, it is preferred for the tank to be integrated in the housing. The tank then forms part of the unit.

It is also advantageous if the pressure booster is arranged in axial extension of the pressure generator. In this case, there is slight axial lengthening of the pump, but this is of no further importance. The flow conditions can be favorably designed in this way.

A motor for driving the pressure generator is preferably rigidly mechanically connected with the pressure generator. In this case, the supply unit additionally includes a motor, so that the whole unit constitutes a power pack, i.e., a unit which is capable of delivering hydraulic fluid or gas under an increased pressure after, for example, electric power or a fuel has been supplied.

In this regard, it is preferred for the motor and the pressure generator to have a common shaft. In this way, losses that could be caused by a transmission are kept small. The motor drives the pump directly.

The motor is preferably designed as an electric motor. An electric motor operates with low emissions. It is easy to control and easy to start. It can be used wherever electric power is available.

In this regard, it is especially preferred for the housing to hold a battery. The battery constitutes a power reserve for the motor, which can be carried along with the motor.

The pressure generator is preferably designed as a pump that has a set of gears. The pressure booster has a higher pressure at its high-pressure side, even after termination of its activity. This pressure can be relieved by means of the set of gears of the pump. Leakage will always occur through a set of gears in the pump, because one cannot get a set of gears of this type completely "tight". The set of gears can be formed, for example, by two gear wheels, which are arranged side by side or one inside the other and mesh with each other or one inside the other. However, the set of gears can also be formed by a gerotor unit or other type of unit in which a gear wheel rotates and/or orbits in a toothed ring.

At least parts of the pressure booster are preferably made of light metal or plastic to achieve weight savings. The unit is then especially suitable for a manual tool.

A pressure relief valve is preferably arranged between the outlet of the pressure generator and a low-pressure connection. The pressure relief valve is also integrated in the unit that contains the pump, the pressure booster, and possibly the motor. By means of the pressure relief valve, it is relatively easy to adjust the desired pressure which the supply unit can produce. If the transformation ratio of the pressure booster is known, then the delivery pressure can be easily set by adjusting the outlet pressure of the pressure generator. For example, if the pressure booster has a transformation ratio of 1:5, and the pressure generator, for example, the pump, is adjusted to 10 bars by means of the pressure relief valve, then one knows that 50 bars are available at the pressure outlet. The adjustment of a pressure in a low-pressure range is often easier than the adjustment of a pressure in a higher pressure range.

The invention is described in greater detail below on the basis of the preferred embodiment illustrated in the drawings.

Figure 1:
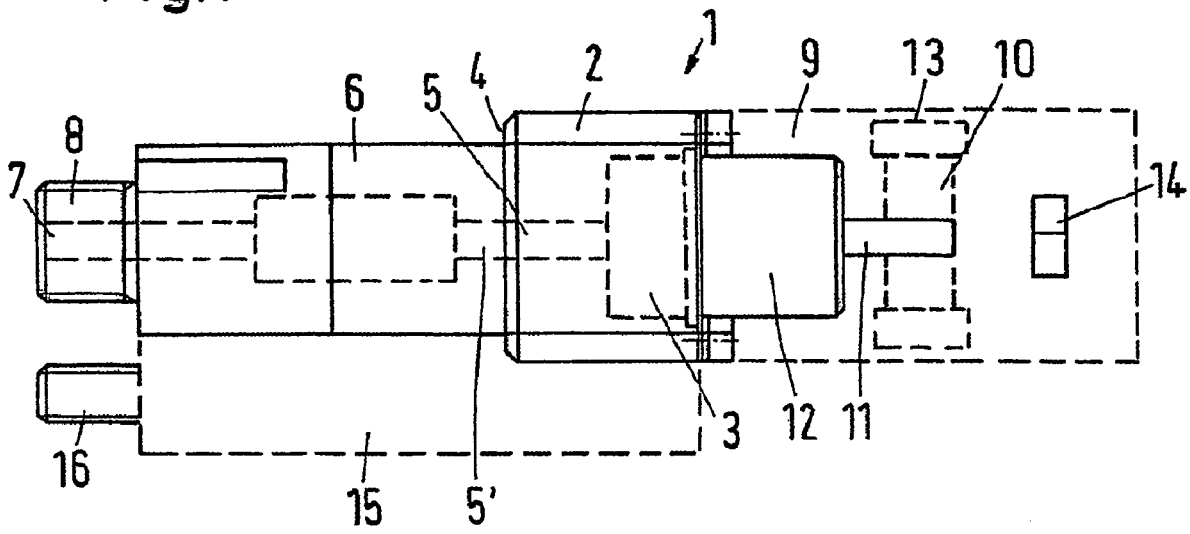
FIG. 1 shows a schematic view of a supply unit from the outside.

The invention is described below on the basis of a hydraulic supply unit. However, it can also be similarly used for a supply unit that delivers gases under an increased pressure. In this case, a compressor is used instead of a pump.

A hydraulic supply unit 1 has a pump 2, which has a set of gears 3 (shown only schematically) that comprises two gear wheels that mesh with each other. A pump of this type is described, for example, in DE 197 17 295 A1, to which reference is made here.

The pump 2 has an end face 4, into which an outlet 5 of the pump 2 opens. A pressure booster 6 is mounted on the end face 4 of the pump. Its inlet 5' meets the outlet 5 of the pump 2. The pressure booster 6 and the pump 2 form a unit, i.e., the pressure booster 6 is mechanically connected with the pump 2. The unit comprising the pump 2 and the pressure booster 6 can only be operated together.

The pressure booster 6 has a pressure outlet 7, which passes through a connecting socket 8, onto which an attachment, for example, a hydraulically operated tool, can be screwed.

The pump 2 and the pressure booster 6 have a common housing that consists of more than one part, namely, a housing for the pump 2 and a housing for the pressure booster 6. The two housings are, for example, screwed together or fastened to each other by other means, specifically, at the end face 4 of the pump 2. The end face 4 forms a joining surface and thus an interface between the pump 2 and the pressure booster 6.

The pump 2 is driven by a motor 9, which is drawn with broken lines. The motor 9 is likewise rigidly connected with the pump 2 or, to be more precise, with its housing. The unit comprising the motor 9, pump 2, and pressure booster 6 can be operated as a unit. The supply unit 1 thus constitutes a power pack, so to speak, i.e., a unit which is capable of on-site delivery of hydraulic fluid or gas under an increased pressure. The pressure is a multiple of the outlet pressure of the pump 2, and the amplification factor is determined by the pressure booster.

The motor 9 has a rotor 10, which is placed directly on the primary shaft or drive shaft 11 of the pump 2. Naturally, however, it is also possible to provide the rotor 10 with its own shaft and then to couple this shaft with the drive shaft 11. In any case, the motor and the pump are arranged on a common axis 12. This facilitates the alignment. The stator 13 of the motor 9 is shown schematically. The motor 9, which can be designed as an electric motor, has a switch 14 with which the supply unit can be started.

A tank 15 is mounted on the unit comprising the pump 2 and pressure booster 6. The tank is also shown only by broken lines. It can also be constructed differently from the tank shown here. Its purpose is to supply the hydraulic fluid which is to be brought to increased pressure by the pump 2 and the pressure booster 6. The tank 15 also has a connection 16 by which hydraulic fluid can be returned to the tank 15.

Figure 2:
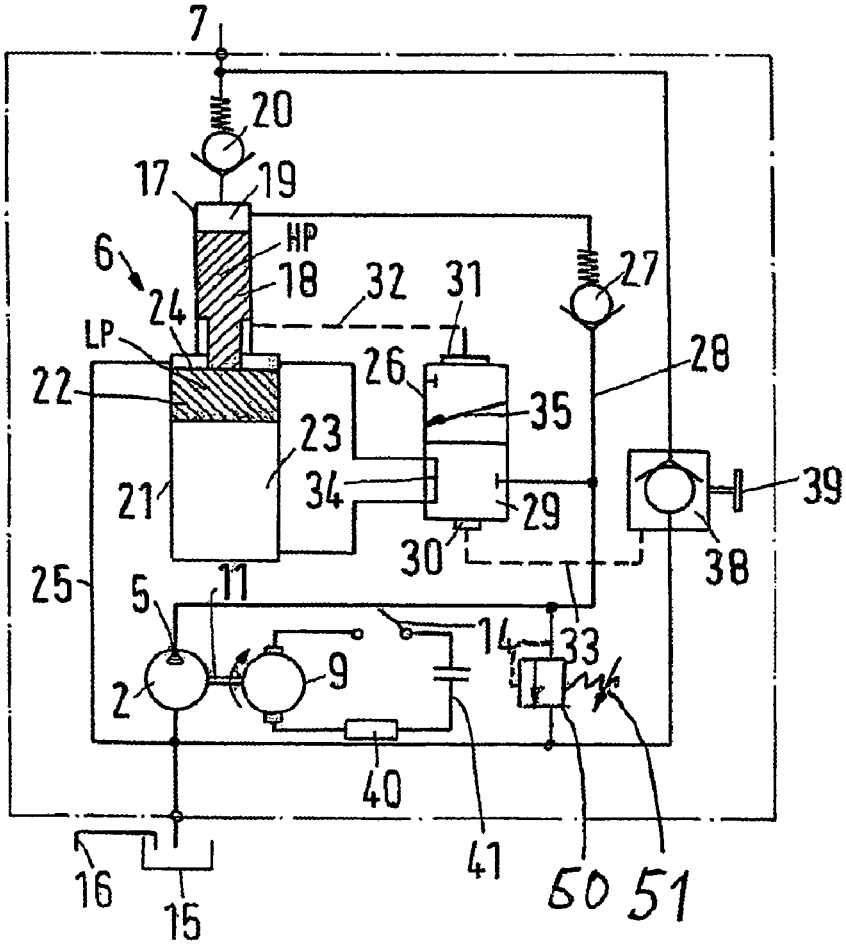
FIG. 2 shows a schematic representation of functional parts of the supply unit.

FIG. 2 shows a functional diagram to explain the supply unit. Parts which are the same as parts in FIG. 1 are labeled with the same reference numbers.

The pressure booster 6 has a high-pressure cylinder 17, in which a high-pressure piston 18 can move. The high-pressure cylinder 17 and the high-pressure piston 18 bound a high-pressure chamber 19, which is connected with the pressure outlet 7 via a check valve 20 that opens towards the pressure outlet 7.

The pressure booster 6 also has a low-pressure cylinder 21, in which a low-pressure piston 22 can move. The low-pressure piston 22 divides the low-pressure cylinder into a first low-pressure chamber 23 and a second low-pressure chamber 24. The second low-pressure chamber 24 is connected to the tank 15 by a line 25 and also extends slightly into the high-pressure cylinder between the high-pressure piston 18 and the low-pressure piston 22.

The high-pressure piston 18 has an effective cross section that is smaller than the cross section of the low-pressure piston 22. The ratio of the cross sections of the high-pressure piston 18 and low-pressure piston 22 determines the amplification achieved by the pressure booster 6. The low-pressure piston 22 and the high-pressure piston 18 are connected. This connection must transmit only compressive forces.

The high-pressure chamber 19 is connected to the outlet 5 of the pump 2 via a check valve 27 that opens towards the high-pressure chamber 19 and via a line 28.

A control valve designed as a switching valve 26 with a valve element 29 has a first control inlet 30, which is connected with the line 28. The first control inlet 30 acts on the valve element 29 with a relatively small pressure application surface.

In the opposite direction, the pressure at a second control inlet 31 acts on the valve element 29, but in this case it acts on it with a greater pressure application surface than at the first control inlet 30. The second control inlet 31 is connected with the high-pressure cylinder 17 by a line 32, which opens into the high-pressure cylinder 17 at a position which is cleared relative to the high-pressure piston 18 at the upper limit of travel of the high-pressure piston 18, specifically, in such a way that the control line 32 is connected with the second low-pressure chamber 24. In the position of the high-pressure piston 18 that is shown in FIG. 2, the second control inlet 31 thus communicates with the tank 15 via the line 32, the second low-pressure chamber 24, and the line 25, so that tank pressure prevails at the second control inlet 31.

If, on the other hand, the high-pressure piston 18 is moved in the opposite direction, i.e., the high-pressure chamber 19 expands, then the high-pressure piston 18 clears the opening of the line 32 into the high-pressure chamber 19, so that the second control inlet 31 is supplied with the pressure in the high-pressure chamber 19 through the control line 32.

The first control inlet 30 communicates via line 33 with line 28 and thus with the outlet 5 of the pump 2. The outlet pressure of the pump 2 constantly prevails at the first control inlet 30.

In the position shown in FIG. 2, the valve element 29 connects the first low-pressure chamber 23 with the second low-pressure chamber 24 by a connecting line 34. Hydraulic fluid displaced from the first low-pressure chamber 23 by a downward movement of the high-pressure piston 18 and the accompanying downward movement of the low-pressure piston 22 is conveyed into the second low-pressure chamber 24. This position of the valve element 29 is reached when the pressure at the second control inlet 31 has dropped to such an extent that the outlet pressure of the pump 2, which acts on the smaller surface at the first control inlet 30, overcomes the force at the second control inlet 31.

If, on the other hand, the valve element 29 is moved into the other position, then the outlet 5 of the pump 2 is connected with the first low-pressure chamber 23 via a route 35 in the valve element 29.

The pressure outlet 7 is connected with the tank 15 via a valve 38, which can be operated by a handle 39.

If the switch 14 is closed, the motor 9 is started. A schematically represented electronic control unit 40 can provide for a certain operating performance of the motor. The supply unit 1 has a battery 41, which is not shown in FIG. 1, for supplying the necessary electric power. It is advantageous for the battery 41 to be housed in the housing. Naturally, if other power sources are available, for example, an alternating-current power grid, they can also be used.

When the motor 9 is started, it drives the pump 2, which removes hydraulic fluid from the tank 15 and feeds it into the line 28. In the process, the following occurs:

The hydraulic fluid enters the high-pressure chamber 19 through line 28 and the check valve 27 and pushes the combination of the high-pressure piston 18 and low-pressure piston 22 downward, so that the volume of the first low-pressure chamber 23 is reduced. The valve element 29 is in the position shown in FIG. 2, because the second control inlet 31 is at tank pressure, and the first control inlet 30 is acted upon by the outlet pressure of the pump 2 through line 33.

As soon as the high-pressure piston 18 clears the opening of the control line 32 into the high-pressure chamber 19, the pressure at the second control inlet 31 changes to the outlet pressure of the pump 2, i.e., the pressures at the two control inlets 30, 31 are equal. However, since the second control inlet 31 acts on the valve element 29 with a larger pressure application surface, the valve element 29 changes its position, so that the line 35 now connects the first low-pressure chamber 23 with the outlet 5 of the pump 2. The hydraulic fluid delivered by the pump 2 now pushes the low-pressure piston 22 and thus the high-pressure piston 18 upward, thereby reducing the volume of the high-pressure chamber 19, and discharges the hydraulic fluid in the high-pressure chamber 19 to the pressure outlet 7 through the check valve 20.

As soon as the high-pressure piston 18 clears the opening of the control line 32 into the second low-pressure chamber 24, the pressure at the second control inlet 31 drops, and the valve element 29 changes its switching position to the position shown in FIG. 2. The cycle then starts over again.

The supply unit I that has been described thus makes it possible to supply both manually operated tools with hydraulic fluid under increased pressure and units that are to be used where no hydraulic supply was previously available, for example, in certain machine tools.

Individual parts of the pressure booster 6, for example, the high-pressure piston 18 and the low-pressure piston 22, can be made of light metal or even plastic to reduce the weight of the supply unit 1. The choice of materials depends on the pressure ratios.

When the switch 14 is opened, pressure relief occurs, because the pump 2 stops operating. In this case, the valve 38 can be opened in order to relieve the pressure on the high-pressure side as well, i.e., to allow hydraulic fluid to drain from the pressure outlet 7 into the tank 15. This can be accomplished by an operator operating the handle 39. However, it is also possible to couple the handle 39 with the switch 14 or the motor 9 by mechanical or electrical means, so that the valve 38 is automatically operated as a function of whether the pump 2 is running or not.

In the embodiment shown here, the motor 9 is designed as an electric motor. This is a very convenient solution. In general, however, other types of drives are also possible, for example, an air motor or an internal combustion engine. The pressure booster described here is also merely an example. Other pressure boosters can also be used, for example, those in which the switching valve 26 is controlled by other means. The function of the switching valve 26 is also shown only schematically. The precise design of the switching valve 26 is unimportant as long as the pressure booster can operate as desired. Thus, it is certainly possible for the valve element 29 of the switching valve 26 to consist of several parts. It is not necessary for it to be designed as a slide valve as long as it can perform a function of the type described.

The hydraulic supply unit 1 can also be operated at lower pressures. In this case, it can be assumed that the service life of the pump 2 and the motor 9 will be greater.

A pressure relief valve 50 with an adjusting device 51 is arranged between the outlet 5 of the pump 2 and the tank 15 or a low-pressure connection that opens into the tank. The pressure relief valve 50 can also be easily integrated in the unit 1, i.e., it can be housed in the housing that holds the pump 2 and the pressure booster 6. The pressure at the outlet 5 of the pump 2 can be adjusted to a predetermined value by means of the pressure relief valve 50, and, of course, this value must be below the maximum possible outlet pressure of the pump 2. Naturally, the adjustment of the pressure at the outlet 5 of the pump 2 is also connected with an adjustment of the pressure at the pressure outlet 7. If the pressure booster has a constant transformation ratio of 1:5, and the pressure at the outlet 5 of the pump 2 is set at 10 bars, then one knows that 50 bars are available at the pressure outlet 7.

The pressure relief valve has the advantage that it can adjust the pressure on the "low-pressure side", which is often easier than adjustment of the pressure on the high-pressure side of the pressure booster 6.

The invention claimed is:

1. A fluid supply unit, comprising a pressure generator for the fluid, and a pressure outlet of the pressure generator, further comprising a pressure booster (6) comprised of a high pressure piston (18) and a low pressure piston (22), wherein the low pressure piston (22) is mounted in a first low pressure chamber (36), and a switching valve (26), which, when switched, causes fluid from the pressure generator (2) to act on the low pressure piston, the pressure booster (6) being installed between the pressure generator (2) and a pressure outlet (7) of the pressure booster and rigidly mechanically connected with the pressure generator (2) wherein the pressure booster (6) is driven by a portion of the fluid generated by the pressure generator, wherein the pressure generator (2) and the pressure booster (6) are installed in a common housing, wherein the pressure outlet of the pressure generator (5) extends in the housing between the pressure generator (2) and the pressure booster (6) and the pressure outlet of the pressure booster extends from an end of the housing, wherein the housing is constructed of more than one part, wherein two of the housing parts have a joining surface (4), and wherein the joining surfaces together form an interface between the pressure generator (2) and the pressure booster (6), and further comprising a tank (15) is integrated in the housing and rigidly connected with the combination of pressure generator (2) and pressure booster (6), which tank holds the portion of fluid for driving the pressure booster (6).

2. The unit in accordance with claim 1, wherein the pressure booster (6) is arranged in axial extension of the pressure generator (2).

3. The unit in accordance with claim 1, comprising a motor (9) for driving the pressure generator (2), wherein the motor is rigidly mechanically connected with the pressure generator (2).

4. The unit in accordance with claim 3, wherein the motor (9) and the pressure generator (2) have a common shaft (11).

5. The unit in accordance with claim 3, wherein the motor (9) is designed as an electric motor.

6. The unit in accordance with claim 5, comprising a battery (41) housed in the housing.

7. The unit in accordance with claim 1, wherein the pressure generator is designed as a pump (2) that has a set of gears.

8. The unit in accordance with claim 1, wherein the pressure booster (6) is at least partially made of light metal or plastic.

9. The unit in accordance with claim 1, comprising a low-pressure connection and a pressure relief valve (50) arranged between the outlet of the pressure generator (2) and the low-pressure connection.

10. The unit according to claim 1, wherein the fluid supply unit comprises a hydraulic supply unit.

* * * * *